US006000806A

United States Patent [19]

Dallman

[11] Patent Number: 6,000,806

[45] Date of Patent: Dec. 14, 1999

[54] LIGHTING APPARATUS FOR AN ATM KIOSK

[75] Inventor: Ernest R. Dallman, Zionsville, Ind.

[73] Assignee: Dallman Industrial Corporation, Indianapolis, Ind.

[21] Appl. No.: 08/996,421

[22] Filed: Dec. 22, 1997

Related U.S. Application Data

[63] Continuation-in-part of application No. 29/047,226, Nov. 29, 1995, Pat. No. Des. 388,227, which is a continuation-in-part of application No. 29/030,926, Nov. 14, 1994, Pat. No. Des. 375,606, which is a continuation-in-part of application No. 29/022,639, May 10, 1994, Pat. No. Des. 361, 192.

[51] Int. Cl.[6] ..... F21V 33/00; E04H 1/12

[52] U.S. Cl. ..... 362/85; 362/133; 362/145; 362/225; 186/37; 902/30

[58] Field of Search ..... 186/37; 52/67; 109/2, 24.1; 705/43; 902/8, 30, 33–35; 362/85, 89, 145, 147, 133, 154, 217, 225, 234, 253, 216

[56] References Cited

U.S. PATENT DOCUMENTS

| | | | |
|---|---|---|---|
| Re. 22,431 | 2/1944 | Sloan, Jr. | 52/67 |
| D. 264,764 | 6/1982 | Freijd | D99/28 |
| D. 284,321 | 6/1986 | Kobayashi | D99/28 |
| D. 286,098 | 10/1986 | Prinzhorn | D99/28 |
| D. 288,011 | 1/1987 | Prinzhorn | D99/28 |
| D. 289,215 | 4/1987 | Prinzhorn | D99/28 |
| D. 293,151 | 12/1987 | Prinzhorn | D99/28 |
| D. 293,269 | 12/1987 | Prinzhorn | D99/28 |
| D. 303,448 | 9/1989 | Noda et al. | D99/28 |
| D. 314,076 | 1/1991 | Tarkany et al. | D99/28 |
| D. 320,047 | 9/1991 | Novak | D20/1 |
| D. 331,996 | 12/1992 | Fukutake et al. | D99/28 |
| 2,140,418 | 12/1938 | Dilts | 312/319.7 |
| 2,185,763 | 1/1940 | Lisle | 312/319.8 |
| 2,590,592 | 3/1952 | Wittemann | 198/468.9 |
| 2,722,179 | 11/1955 | Belew | 109/19 |
| 2,963,333 | 12/1960 | Mestre | 109/24.1 |
| 3,028,209 | 4/1962 | Hinkel et al. | 312/319.7 |
| 3,091,816 | 6/1963 | Wetzel | 108/172 |
| 3,728,017 | 4/1973 | Schmidlin et al. | 355/18 |
| 3,897,901 | 8/1975 | Grosswiller, Jr. et al. | 109/24.1 |
| 4,164,010 | 8/1979 | Finch | 362/147 |
| 4,179,723 | 12/1979 | Spencer | 902/30 |
| 4,192,544 | 3/1980 | Patterson | 296/165 |
| 4,399,755 | 8/1983 | Wiedmann | 109/2 |
| 4,457,492 | 7/1984 | Lahti | 254/8 B |
| 4,497,261 | 2/1985 | Ferris et al. | 109/2 |
| 4,513,670 | 4/1985 | Berman | 109/24.1 |
| 4,557,352 | 12/1985 | Tschappat, Jr. | 186/37 |
| 4,558,650 | 12/1985 | Berman | 109/24.1 |
| 4,577,562 | 3/1986 | Berman | 109/24.1 |
| 4,603,643 | 8/1986 | Couvrette | 109/24.1 |
| 4,615,280 | 10/1986 | Shoop et al. | 902/30 |
| 4,649,832 | 3/1987 | Hain et al. | 109/24.1 |
| 4,681,044 | 7/1987 | Dallman | 109/24.1 |
| 4,720,154 | 1/1988 | Seiter | 312/319.8 |
| 4,813,475 | 3/1989 | Couvrette | 165/223 |
| 4,856,437 | 8/1989 | Trucksess | 109/24.1 |
| 5,036,779 | 8/1991 | Capraro | 109/24.1 |
| 5,052,878 | 10/1991 | Brockhaus | 414/522 |
| 5,087,107 | 2/1992 | Fumanelli | 312/333 |
| 5,215,363 | 6/1993 | Warwick, III | 312/274 |
| 5,217,088 | 6/1993 | Dallmann | 186/37 |
| 5,222,445 | 6/1993 | Capraro | 109/2 |
| 5,275,064 | 1/1994 | Hobbs | 74/110 |
| 5,299,511 | 4/1994 | Dallmann et al. | 109/24.1 |
| 5,440,999 | 8/1995 | Dallmann et al. | 109/24.1 |
| 5,577,830 | 11/1996 | Barry et al. | 362/152 |
| 5,611,288 | 3/1997 | Dallmann et al. | 109/50 |
| 5,615,623 | 4/1997 | Capraro, Jr. | 109/2 |

FOREIGN PATENT DOCUMENTS

| | | |
|---|---|---|
| 3-50694 | 3/1991 | Japan . |
| 976991 | 12/1964 | United Kingdom . |

*Primary Examiner*—Alan Cariaso
*Attorney, Agent, or Firm*—Barnes & Thornburg

[57] ABSTRACT

An apparatus is configured to provide a secure enclosure for an ATM. The apparatus includes a kiosk having an interior region configured to provide access to the ATM, and a neon light source formed as an integral portion of the kiosk. The neon light source is configured to provide a sufficient light output to meet required light levels at specific distances from the kiosk without the use of light sources outside the kiosk.

25 Claims, 8 Drawing Sheets

LIGHTING APPARATUS FOR AN ATM KIOSK

BACKGROUND AND SUMMARY OF THE INVENTION

This application is a continuation-in-part of U.S. application Ser. No. 29/047,226, filed Nov. 29, 1995, now U.S. Pat. No. Des. 388,227 which is a continuation-in-part of U.S. application Ser. No. 29/030,926, filed Nov. 14, 1994, now U.S. Pat. No. Des. 375,606, which is a continuation-in-part of U.S. application Ser. No. 29/022,639, filed May 10, 1994, now U.S. Pat. No. Des. 361,192.

The present invention relates to buildings or kiosks for housing an automatic teller machine (ATM). More particularly, the present invention relates to an improved security lighting apparatus for the kiosk.

In recent years, a large number of ATMs have been installed at locations remote from main buildings of a bank. These separate buildings or kiosks house an ATM and provide 24-hour access to walk-up or drive-up customers. Security is an important issue at these remote ATM kiosks. It is known to move the ATM from a retracted position within the kiosk to an extended position for servicing. See, for example, U.S. Pat. Nos. 5,299,511; 5,440,999; and 5,611,288.

Each state has specific lighting codes which establish required light levels at specific distances from the ATM kiosks. Specifically, California and other states have approved lighting code requirements of 10 foot candles at a distance of 15 feet from the kiosk, and 2 foot candles at a distance of 50 feet from the kiosk. The elevation from grade of the light meter reading is typically about 3 feet.

Typically, in order to install kiosks, the owner must also install a secondary light source adjacent the kiosk in order to comply with the specific lighting code light level requirements. These auxiliary lights may be a separate standing security light on a pole adjacent the kiosk or a separate light source which must be coupled to the kiosk. A light source coupled to the kiosk is subject to damage by vehicles driving too close to the kiosk.

The present invention uses light sources internal to the kiosk to provide enough light to illuminate an area around the kiosk to meet the required light levels specified by lighting codes without the use of a secondary light source separate from the kiosk. This save construction costs since all the required lighting is internal to the kiosk.

The neon security lighting apparatus of the present invention emits the necessary lumens to reach lighting code levels. The neon lighting system provides whiter light than fluorescent lighting, provides increased bulb life (about 10–15 years), and reduces operating costs to approximately ⅔ the cost of fluorescence. The neon lighting apparatus also improves the appearance of the building because the ability to adjust the length, curvature, and design of neon lighting tubes far surpasses the inflexible, straight, exact length requirements of fluorescent tubes.

According to one aspect of the present invention, an apparatus is configured to provide a secure enclosure for an ATM. The apparatus includes a kiosk having an interior region configured to provide access to the ATM, and a neon light source formed as an integral portion of the kiosk. The neon light source is configured to provide a sufficient light output to meet required light levels at specific distances from the kiosk.

Illustratively, the neon light source provides at least 10 foot candles of light at a distance of about 15 feet from the kiosk. The neon light source provides at least 2 foot candles of light a at distance of about 50 feet from the kiosk. These outputs may be changed to meet lighting code requirements.

In illustrated embodiments, the light source is located within about the top 50% of the kiosk. Illustratively, the light source is located within the top 30% of the kiosk nearest the top surface of the kiosk.

Also illustratively, the neon light source includes an array of neon tubes and a transformer coupled to the array of neon tubes. The array of neon tubes is coupled to a support. The support is configured to be secured to a portion of the kiosk within an enclosure space defined by the kiosk.

The support and the array of tubes are illustratively aligned at an acute angle relative an outer wall of the kiosk. The neon light source is illustratively angled downwardly relatively to a sidewall of the kiosk by an angle of about 10 degrees to about 95 degrees. The illustrated embodiments show the angle of the neon light source at about 45 degrees.

In another illustrated embodiment, the kiosk includes at least two sides and the neon light source is configured to extend along the at least two sides of the kiosk. The neon light source may be configured to extend substantially around an outer periphery of the kiosk if desired or required to meet lighting code requirements.

According to another aspect of the present invention, an apparatus is configured to provide a secure enclosure for an ATM. The apparatus includes a kiosk having an interior region configured to provide access to the ATM, and a light source formed as an integral portion of the kiosk. The integrally formed light source is angled downwardly relatively to a sidewall of the kiosk by an angle of about 10 degrees to about 95 degrees. Illustratively, the angle of the light source is about 45 degrees.

Additional objects, features, and advantages of the invention will become apparent to those skilled in the art upon consideration of the following detailed description of illustrated embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
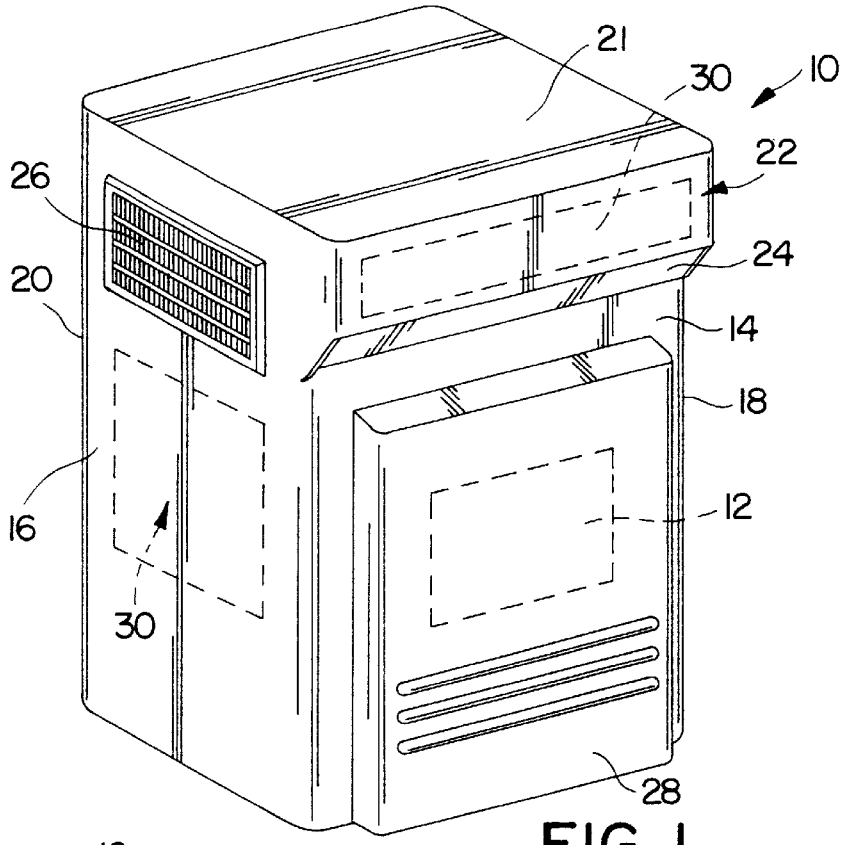
FIG. 1 is a perspective view of an ATM kiosk for housing an ATM at a location remote from the bank in which the kiosk includes a security light source and illuminated signage.
Figure 2:
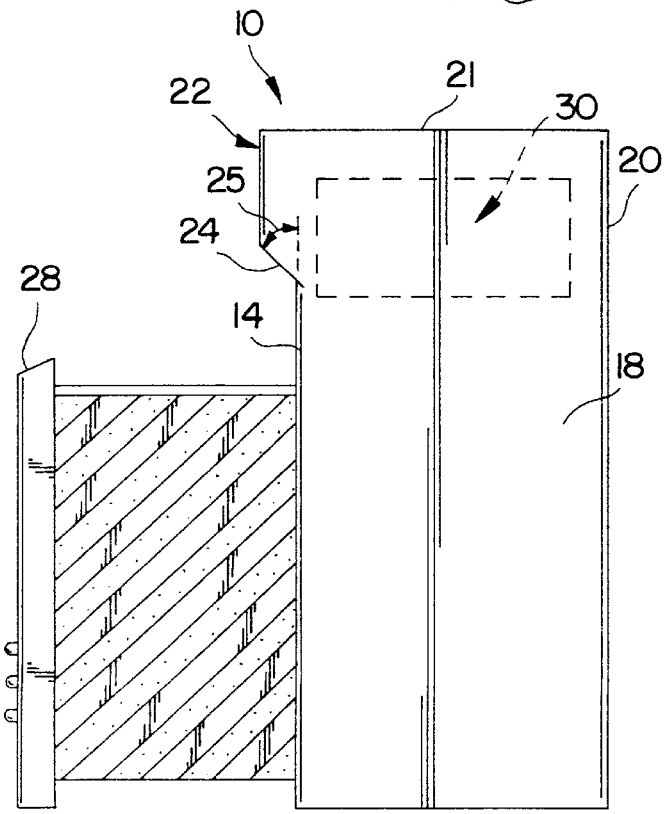
FIG. 2 is a side elevational view of the kiosk of FIG. 1 illustrating the ATM moved to an extended position for servicing.
Figure 3:
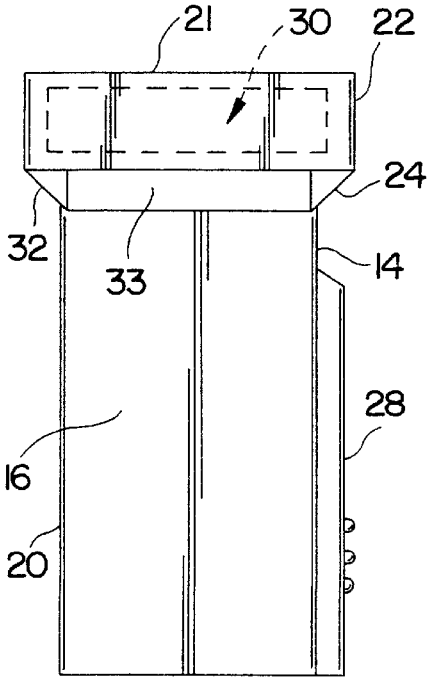
FIG. 3 is a side elevational view of another embodiment of the kiosk of the present invention.

Referring now to the drawings, FIG. 1 illustrates one embodiment of a building or kiosk 10 for housing an ATM 12 at a location remote from a bank. The kiosk 10 can be placed at any desired location to provide 24-hour access to walk-up or drive-up customers. The kiosk 10 includes a front wall 14, opposite side walls 16 and 18, and a rear wall 20. Kiosk 10 further includes a top surface 21 and a bulkhead 22 having a light source 24. Side wall 16 includes a vent 26. A platen 28 extends beyond front wall 14 of kiosk 10. Light source 24 in FIGS. 1–3 is illustratively angled downwardly relative to a plane of front wall 14 at about 45 degrees as illustrated by angle 25 in FIG. 2. Preferably, the angle 25 of light source 24 ranges from about 10 degrees to about 95 degrees in accordance with the present invention. It if understood that other angles may be used depending upon the particular application. For instance, the angle of light sources 24, 32, and 33 may be manufactured at an optimum angle depending upon the grade surrounding the kiosk 10.

Figure 6:
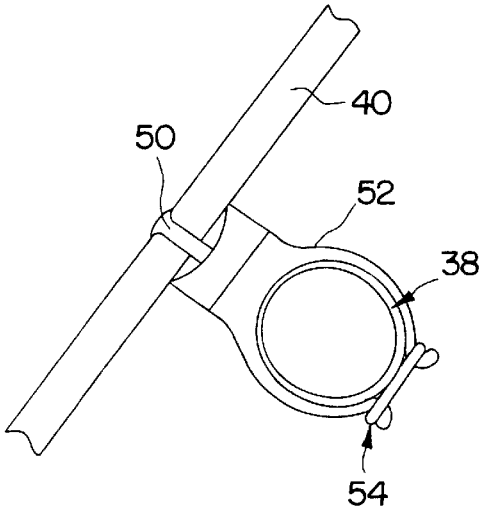
FIG. 6 is a sectional view taken through one of the neon lighting tubes.
Figure 7:
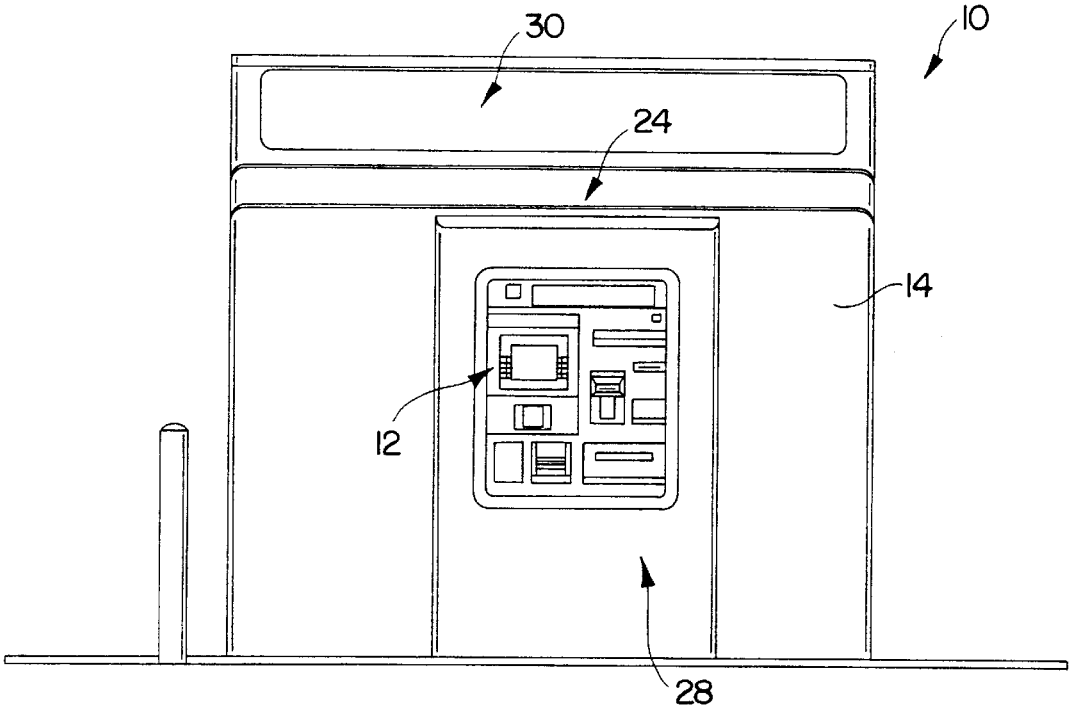
FIGS. 7, 9, 11, 13, 15 and 17 are front views illustrating other embodiments of the ATM kiosks which include various types of lighting sources.
Figure 8:
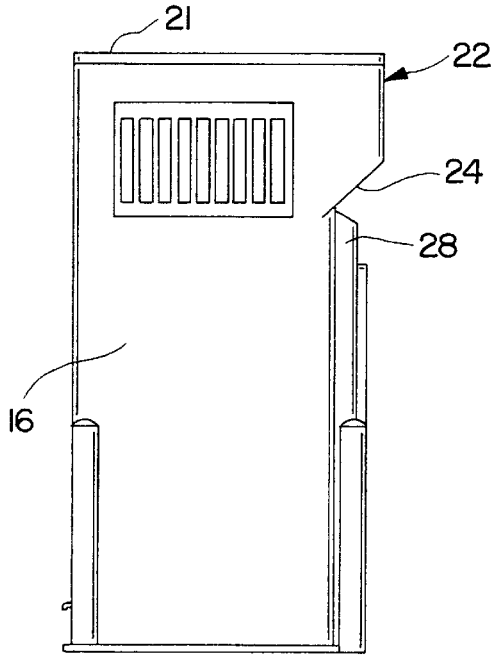
FIGS. 8, 10, 12, 14, 16 and 18 are side elevational views of the embodiments of FIGS. 7, 9, 11, 13, 15 and 17, respectively.
Figure 9:
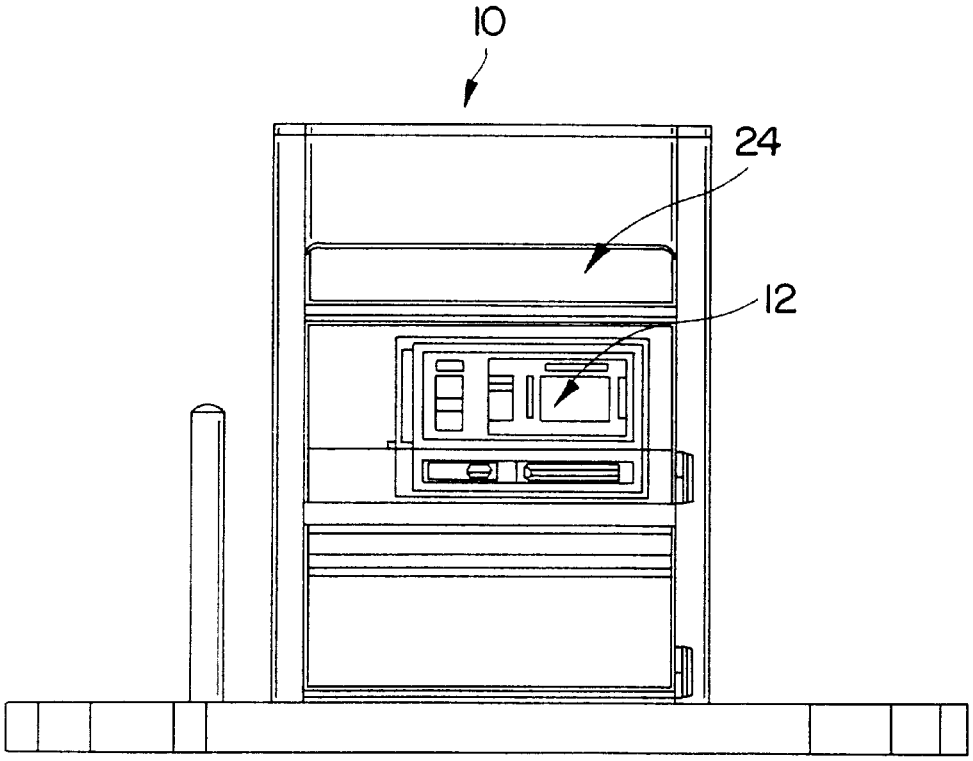
Figure 10:
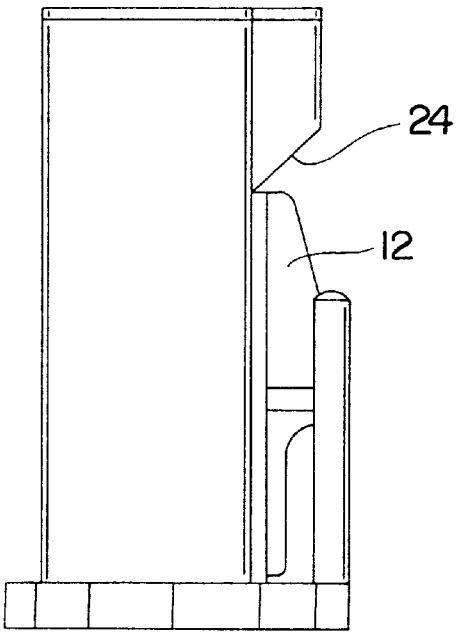
Figure 11:
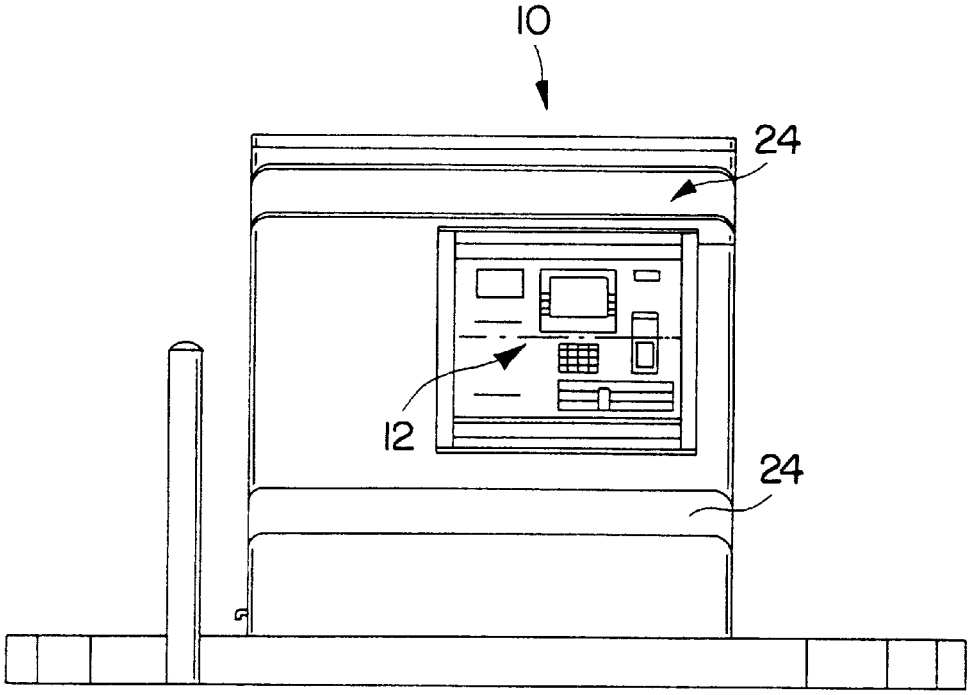
Figure 12:
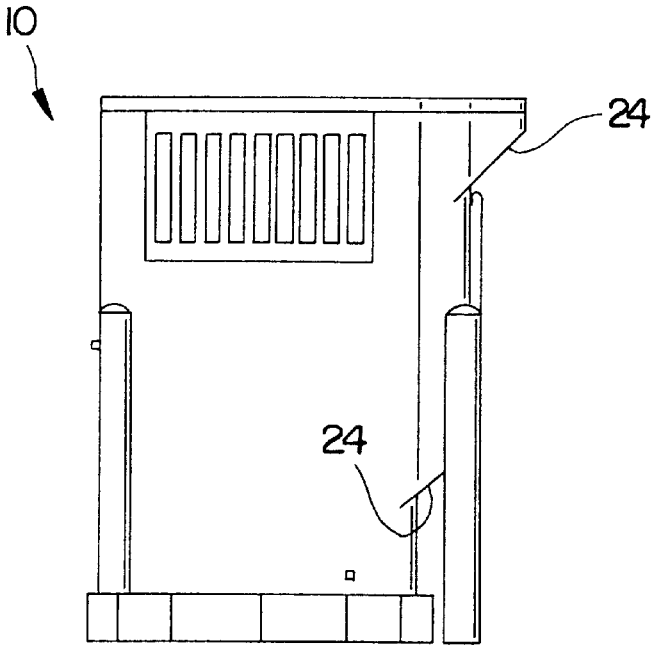
Figure 13:
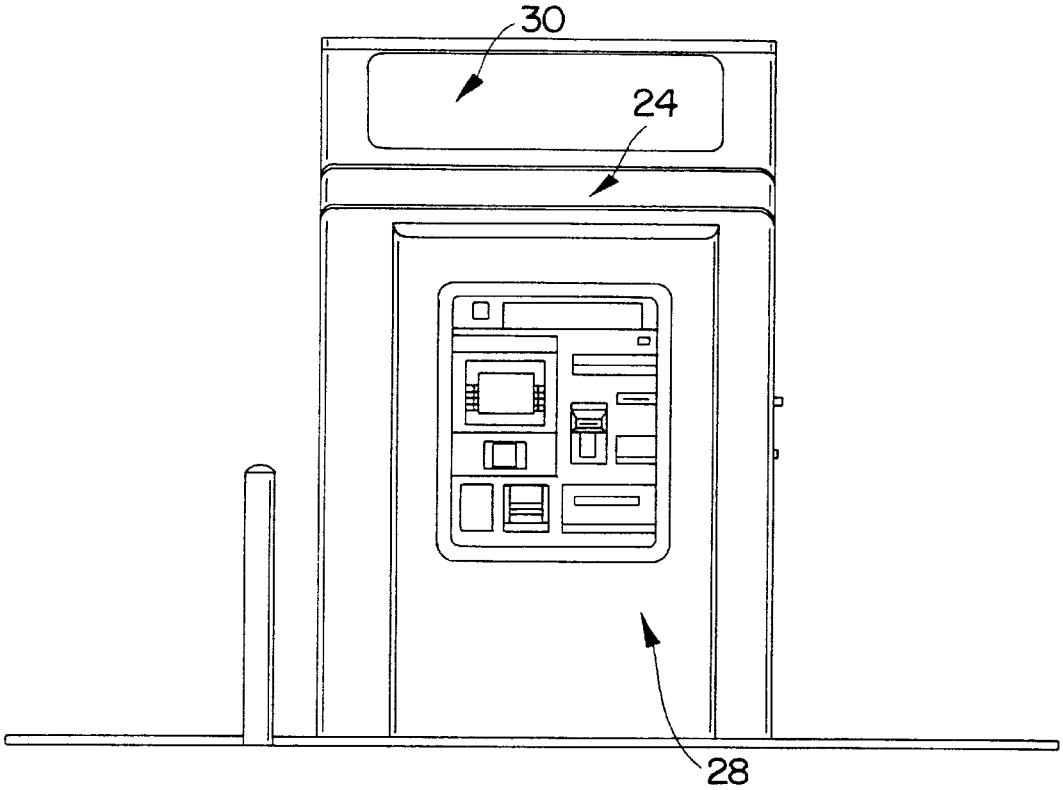
Figure 14:
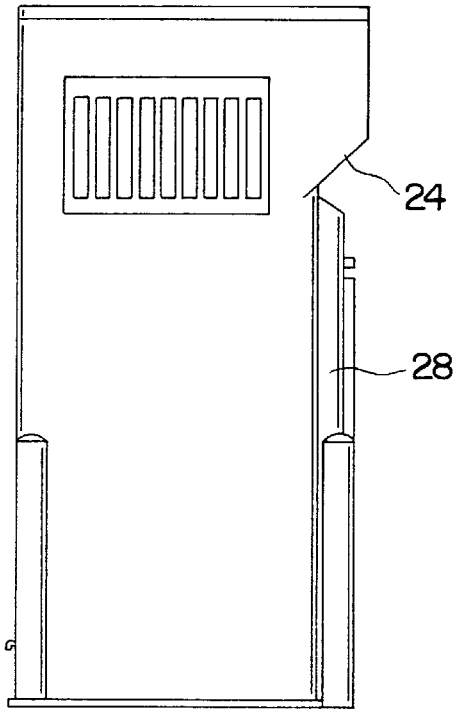
Figure 15:
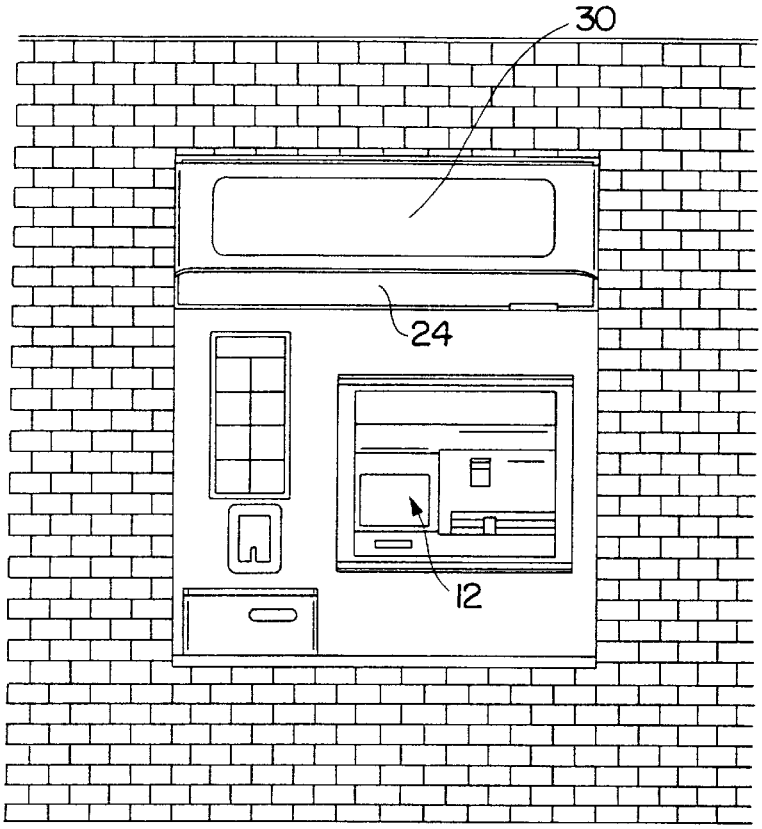
Figure 16:
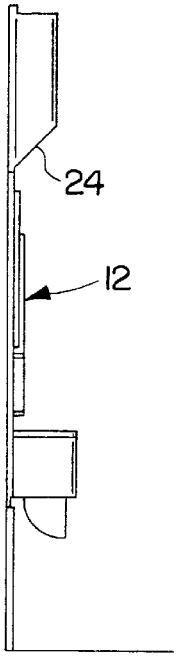
Figure 17:
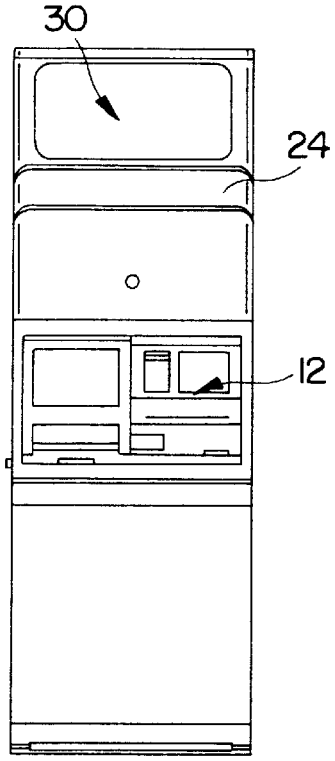
Figure 18:
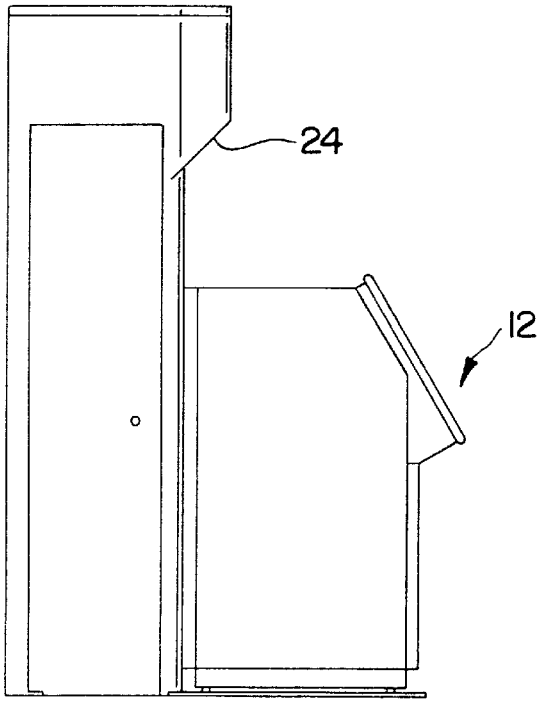

The kiosk 10 includes a conventional drive mechanism for moving the ATM from a retracted position illustrated in FIG. 1 to an extended position illustrated in FIG. 6 for servicing of the ATM. An operator can enter through a rear door (not shown) formed in rear wall 20 of kiosk 10 to maintain the ATM. Suitable drive mechanisms are disclosed in U.S. Pat. Nos. 5,299,511; 5,440,999; and 5,611,288.

In addition to light source 24, kiosk 10 may be formed to include illuminated signage 30 on side walls 16 or 18 or on bulkhead 30 as illustrated by the dotted lines in FIGS. 1 and 2. FIG. 3 illustrates an embodiment in which another light source 32 is formed on rear wall 20 of kiosk 10. Light sources 33 may also be formed on side walls 16 and 18. Light sources 32 and 33 are also illustratively angled downwardly. Therefore, light sources 24, 32, and 33 may extend around the entire periphery of the structure 10 if desired or if required to meet lighting code requirements.

Figure 4:
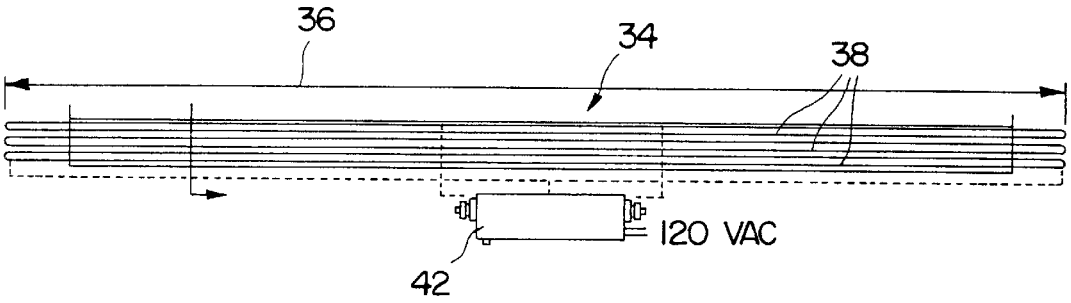
FIG. 4 is a front view of an array of neon lighting tubes used as a light source in the present invention.
Figure 5:
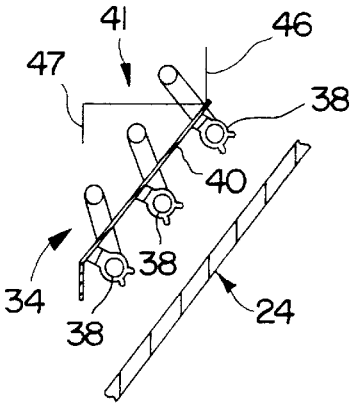
FIG. 5 is a sectional view taken along lines 5—5 of FIG. 4 illustrating further details of the array of neon tubes.

The light sources 24, 32 and 33 on the kiosk 10 are provided an array of neon lighting tubes as illustrated in FIGS. 4–6. Light sources conventionally used in ATM buildings, such as incandescent lighting, provide light to illuminate any signage and to provide some light adjacent the kiosk. However, such conventional light sources may not provide enough light to comply with ATM lighting codes. In other words, a secondary light source such as free standing pole mounted security light or a separate security light coupled to the kiosk must be provided to meet light levels at specific distances which are required by law.

The lighting source of the present invention includes an array 34 of high output neon tubes 38 illustrated in FIGS. 4 and 5. The tubes 38 extend a first distance 36 and include a midpoint ground. The length 36 of tubes 38 may vary depending upon dimensions of the kiosk 10. Each tube 38 is mounted to a support panel 40 as discussed below. A high output transformer 42 is coupled to tubes 38 in a conventional manner. Illustratively, the transformer is a 15 kV, 60 mA transformer. Transformer 42 is illustratively supplied with a 120 VAC power supply.

FIG. 5 illustrates further details of the array 34 of neon bulbs 38. Support 40 includes a flanges 46 and 47 for mounting the array 34 of tubes 38 within portions of the kiosk 10. Array 34 of tubes 38 may be aligned at an angle as shown in FIG. 5. The support 40 is coupled to the kiosk 10 within an enclosure space 41 defined by the kiosk 10.

FIG. 6 illustrates further details of mounting of the tubes 38 on the support 40. A fastener 50 is used to secure a coupler 52 to support 40. Tube 38 is surrounded by coupler 52. A band 54 holds the tube 38 within the coupler 52. Illustratively, tube 38 is a 15 mm, 6500 white neon glass. Tubes 38 double back at both ends to provide a continuous tube for holding the neon gas. Connections between the tubes 38 are illustrated by dotted lines in FIG. 4.

The array 34 of neon bulbs 38 provide light sources 24, 32 and 33 for the ATM kiosk 10. Separate lights are provided for each sign 30 or light source 24, 32, 33. The neon lighting system of the present invention also provides required light levels adjacent the ATM kiosk 10 to meet ATM lighting codes and light levels required by state law. Specifically, the neon lighting system of the present invention provides at least 10 foot candles of light at a distance of about 15 feet from the kiosk and at least 2 foot candles of light at a distance of about 50 feet from the kiosk in order to comply with lighting code requirements. Therefore, secondary light sources such as separate security lights are not required with the present invention.

FIGS. 7–18 illustrate other embodiments of the ATM kiosk 10 of the present invention. Those numbers referenced by the same numbers as FIGS. 1–3 perform the same or similar function.

The neon light sources may be located at any desired locations on the kiosks 10. Illustratively, in FIGS. 1–3 and 7–18, the light sources are located within about the top half of the kiosk 10 for visibility and improved lighting. Typically, the light sources 24, 32 and 33 are located within about the top 30% of the kiosk 10. In other words, the light sources are typically located within about 30% of the total building height away from top surface 21.

Although the invention has been described in detail with reference to certain illustrated embodiments, variations and modifications exist within the scope and spirit of the present invention as defined in the following claims.

What is claimed is:

1. An apparatus configured to provide a secure enclosure for an ATM, the apparatus comprising:

a kiosk having an interior region configured to provide access to the ATM; and a neon light source formed as an integral portion of the kiosk, the neon light source being configured to provide a predetermined light output level at a predetermined distance from the kiosk wherein the distance is further from a bottom front of the kiosk than light directed to the bottom front from a horizontal opening at a top of the kiosk.

2. The apparatus of claim 1, wherein the light source is located within about the top 50% of the kiosk.

3. The apparatus of claim 1, wherein the light source is located within the top 30% of the kiosk nearest the top surface of the kiosk.

4. The apparatus of claim 1, further comprising illuminated signage on the kiosk, the signage being illuminated with a second light source.

5. The apparatus of claim 1, wherein the neon light source includes an array of neon tubes and a transformer coupled to the array of neon tubes.

6. The apparatus of claim 5, wherein the array of neon tubes is coupled to a support, the support being configured to be secured to a portion of the kiosk within an enclosure space defined by the kiosk.

7. The apparatus of claim 6, wherein the support and the array of tubes are aligned at an acute angle relative an outer wall of the kiosk.

8. The apparatus of claim 1, wherein the neon light source provides at least 10 foot candles of light at a distance of about 15 feet from the kiosk.

9. The apparatus of claim 8, wherein the neon light source provides at least 2 foot candles of light at a distance of about 50 feet from the kiosk.

10. The apparatus of claim 1, wherein the neon light source is angled downwardly relatively to a sidewall of the kiosk by an angle of about 10 degrees to about 95 degrees.

11. The apparatus of claim 10, wherein the angle of the neon light source is about 45 degrees.

12. The apparatus of claim 1, wherein the kiosk includes at least two sides and the neon light source is configured to extend along the at least two sides of the kiosk.

13. The apparatus of claim 1, wherein the neon light source is configured to extend substantially around an outer periphery of the kiosk.

14. An apparatus configured to provide a secure enclosure for an ATM, the apparatus comprising:

a kiosk having an interior region configured to provide access to the ATM; and a light source formed as an integral portion of the kiosk, the light source having a light emitting opening angled downwardly and towards a sidewall of the kiosk by an angle of about 10 degrees to about 95 degrees so as to be visible in both a horizontal and vertical direction.

15. An apparatus configured to provide a secure enclosure for an ATM, the apparatus comprising:

a kiosk having an interior region configured to provide access to the ATM; and a light source formed as an integral portion of the kiosk, the light source being angled downwardly relatively to a sidewall of the kiosk by an angle of about 45 degrees.

16. The apparatus of claim 14, wherein the light source includes an array of tubes coupled to a support, the support being configured to be secured to a portion of the kiosk within an enclosure space defined by the kiosk.

17. An apparatus configured to provide a secure enclosure for an ATM, the apparatus comprising:

a kiosk having an interior region configured to provide access to the ATM; and a light source formed as an integral portion of the kiosk, the, light source being angled downwardly relatively to a sidewall of the kiosk by an angle of about 10 degrees to about 95 degrees, the light source being a neon light source configured to provide at least 10 foot candles of light at a distance of about 15 feet from the kiosk.

18. The apparatus of claim 17, wherein the neon light source provides at least 2 foot candles of light at a distance of about 50 feet from the kiosk.

19. The apparatus of claim 14, wherein the kiosk includes at least two sides and the light source is configured to extend along the at least two sides of the kiosk.

20. An apparatus configured to provide a secure enclosure for an ATM, the apparatus comprising:

a kiosk having an interior region configured to provide access to the ATM; and a light source formed as an integral portion of the kiosk, the light source being angled downwardly relatively to a sidewall of the kiosk by an angle of about 10 degrees to about 95 degrees, the light source being configured to extend substantially around an outer periphery of the kiosk.

21. The apparatus of claim 5 wherein a vertical height above the ATM of at least one of the tubes in the array of tubes is different from a vertical height above the ATM of another one of tubes in the array of tubes.

22. The apparatus of claim 5 wherein each tube of the array has a front portion and a rear portion and with the front portion located at a vertical height above the ATM below a vertical height above the ATM of the rear portion.

23. The apparatus of claim 21 wherein each tube of the array has a front portion and a rear portion and with the front portion located at a vertical height above the ATM below a vertical height above the ATM of the rear portion.

24. The apparatus of claim 22 wherein a difference of vertical heights between the front and rear portions of one of said tubes in the array, differs from a corresponding difference in vertical heights of another tube of the array.

25. The apparatus of claim 23 wherein a difference of vertical heights between the front and rear portions of one of said tubes in the array, differs from a corresponding difference in vertical heights of another tube of the array.

* * * * *